US008726537B2

(12) United States Patent
Palander

(10) Patent No.: US 8,726,537 B2
(45) Date of Patent: May 20, 2014

(54) METHOD AND STRAND SINTERING EQUIPMENT FOR CONTINUOUS SINTERING OF PELLETIZED MINERAL MATERIAL

(75) Inventor: Marko Palander, Inkoo (FI)

(73) Assignee: Outotec Oyj, Espoo (FI)

( * ) Notice: Subject to any disclaimer, the term of this patent is extended or adjusted under 35 U.S.C. 154(b) by 295 days.

(21) Appl. No.: 13/387,724

(22) PCT Filed: Aug. 3, 2010

(86) PCT No.: PCT/FI2010/050615
§ 371 (c)(1),
(2), (4) Date: Jan. 27, 2012

(87) PCT Pub. No.: WO2011/015713
PCT Pub. Date: Feb. 10, 2011

(65) Prior Publication Data

US 2012/0124856 A1 May 24, 2012

(30) Foreign Application Priority Data

Aug. 4, 2009 (FI) ..... 20095821

(51) Int. Cl.
*F26B 11/02* (2006.01)

(52) U.S. Cl.
USPC ..... 34/367; 34/370; 34/169; 34/174; 34/181; 34/196; 525/191; 525/200; 525/240; 424/465; 424/468; 166/252.1; 166/268; 166/285

(58) Field of Classification Search
USPC ..... 34/359, 362, 367, 370, 377, 167, 169, 34/174, 181, 196; 525/132, 191, 200, 240; 424/465, 468; 166/252.1, 268, 285
See application file for complete search history.

(56) References Cited

U.S. PATENT DOCUMENTS

| | | | | |
|---|---|---|---|---|
| 3,396,477 | A * | 8/1968 | Nora | 34/85 |
| 3,400,465 | A * | 9/1968 | Von Stroh | 34/443 |
| 4,501,412 | A | 2/1985 | Sweat | |
| 5,428,906 | A * | 7/1995 | Lynam et al. | 34/379 |
| 5,557,873 | A * | 9/1996 | Lynam et al. | 34/379 |
| 6,754,979 | B2 * | 6/2004 | Ludwig et al. | 34/372 |

(Continued)

FOREIGN PATENT DOCUMENTS

| | | | | |
|---|---|---|---|---|
| DE | 19945771 | C1 * | 2/2001 | C10B 49/02 |
| EP | 1271053 | A2 * | 1/2003 | F23G 5/50 |

(Continued)

OTHER PUBLICATIONS

Pirjo Kauraala, International search report for PCT/FI2010/050615, Oct. 20, 2010.

(Continued)

*Primary Examiner* — Steve M Gravini
(74) *Attorney, Agent, or Firm* — Chernoff Vilhauer McClung & Stenzel, LLP

(57) ABSTRACT

In a method and equipment for continuous sintering of pelletized mineral material, a partition wall (7, 8) arranged between two adjacent cooling chambers (4, 5; 5, 6) is in the height direction placed at a distance from the pellet bed (2), so that in between the partition wall (7, 8) and pellet bed (2), there is left a gap (s) that allows gas to flow between two adjacent cooling chambers (4, 5; 5; 6) through the gap (s) in order to equalize the pressure between the cooling chambers.

2 Claims, 2 Drawing Sheets

(56) References Cited

U.S. PATENT DOCUMENTS

Figure 1:
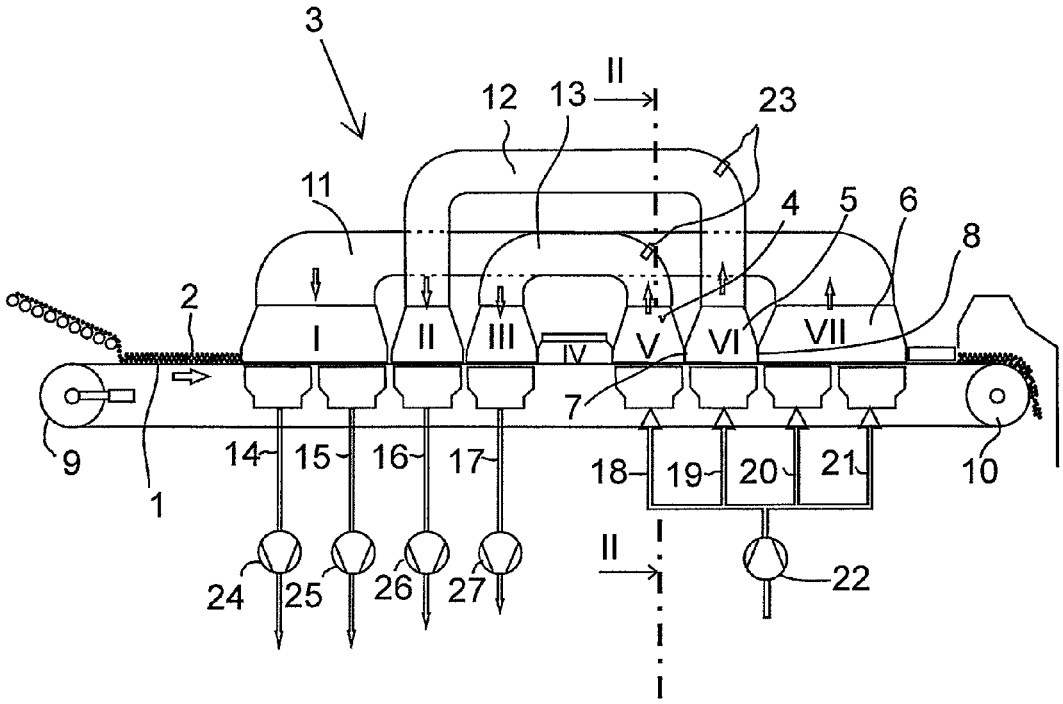

| | | | | |
|---|---|---|---|---|
| 2003/0000100 | A1* | 1/2003 | Ludwig et al. | 34/62 |
| 2012/0124856 | A1* | 5/2012 | Palander | 34/429 |

FOREIGN PATENT DOCUMENTS

| | | | | | |
|---|---|---|---|---|---|
| GB | 1389948 | A | * | 4/1975 | |
| JP | 55131118 | A | | 10/1980 | |
| JP | 03088749 | A | * | 4/1991 | C04B 18/08 |
| JP | 4043286 | A | | 2/1992 | |
| JP | 2000226618 | A | | 8/2000 | |

OTHER PUBLICATIONS

IA Backman, Finnish search report for FI 20095821, May 24, 2010.

* cited by examiner

METHOD AND STRAND SINTERING EQUIPMENT FOR CONTINUOUS SINTERING OF PELLETIZED MINERAL MATERIAL

This is a national stage application filed under 35 U.S.C. 371 based on International Application No. PCT/FI2010/050615 filed Aug. 3, 2010, and claims priority under 35 U.S.C. 119 of Finnish Patent Application No. FI 20095821 filed Aug. 4, 2009.

FIELD OF INVENTION

The invention relates to a method defined in the preamble of claim 1. The invention further relates to equipment defined in the preamble of claim 2.

BACKGROUND OF INVENTION

Continuous strand sintering is used, after pelletizing powdery mineral material, for agglomerating pellets, which improves the strength and reactivity of the pellets. In this specification, the term 'mineral material' refers to a mineral that has similar crystal chemistry properties as those of the oxide group and contains the metal to be recovered, the metal being mainly present as compounds of metal and oxygen.

A strand sintering furnace is divided into several sequential zones, with different temperature conditions prevailing in each one of them. The strand sintering equipment includes a perforated conveyor belt, which is conveyed as an endless loop around two deflector rolls. At the forward end of the furnace, wet fresh pellets are fed onto the conveyor belt to form a bed with a thickness of a few decimeters. The conveyor belt conveys the bed of pellets through the drying, heating, sintering and equalizing zones of the sintering furnace, and further through sequential cooling zones. The cooling zones comprise cooling chambers that are separated by partition walls. After traveling through the cooling zones, the pellets are discharged at the tail end of the strand sintering equipment in a sintered form. To optimize the energy economy, the energy contained in the cooling gases at the tail end of the furnace is used for drying, heating and sintering at the forward end of the furnace, wherefore the strand sintering equipment includes overhead circulation gas ducts for realizing the gas circulation mentioned above. Burners are placed in the circulation gas ducts, and they are used to increase the temperature of the conducted gas up to the sintering temperature required in the sintering process. Below the conveyor belt, there are provided lower exhaust gas ducts for conducting out, through washers, the gas that exits each drying/heating/sintering zone, and has been conducted through the pellet bed and the conveyor belt. Below the conveyor belt, there are arranged lower inlet gas ducts for conducting the gas to the cooling zones. The movement of the gas in the ducts is provided by means of blowers, which are arranged in the lower exhaust and inlet gas ducts.

In a known strand sintering furnace, the partition wall between the sequential adjacent cooling chambers is placed so near to the surface of the pellet bed that any gas exchange cannot essentially take place in between the cooling chambers. Therefore the pressure prevailing in adjacent cooling chambers can be different, when a different quantity of gas is sucked from a certain cooling chamber than what is blown in from below. The drawback is that the gas quantity to be blown in from below must be accurately adjusted at each cooling chamber separately. Yet another drawback is that for each cooling chamber, it has been necessary to provide a specific blower. A large quantity of blowers in turn makes the equipment expensive.

OBJECT OF INVENTION

The object of the invention is to eliminate the above mentioned drawbacks.

A particular object of the invention is to introduce a method and equipment that make it possible to reduce the number of blowers and to improve cooling, in which case the cooling section can be made shorter.

SUMMARY OF INVENTION

The method according to the invention is characterized by what is presented in claim 1. The strand sintering equipment according to the invention is characterized by what is presented in claim 2.

According to the invention, the method allows gas circulation on top of the pellet bed, between two adjacent cooling zones, in order to equalize pressure therebetween.

According to the invention, in a strand sintering equipment, the partition wall placed in between two adjacent cooling chambers is in the height direction placed at a distance from the pellet bed, so that between the partition wall and the pellet bed, there is left a gap for allowing gas circulation between two adjacent cooling chambers through said gap, in order to equalize the pressure between the cooling chambers.

When the partition wall of the cooling chambers is raised higher from the pellet bed than before, so that on top of the pellet bed, gas also has access to the adjacent cooling chamber when necessary, in order to equalize the pressure, there is achieved the effect that the pressure on top of the bed is equalized better than before, even if the gas quantity sucked from one of the cooling chambers was different than the quantity that is blown therein from below. Now the gas quantity to be blown in from below need not be accurately adjusted at each cooling chamber separately, which means that it is possible to combine cooling blowers and thus save expenses. Moreover, the cooling is made more effective throughout, so that the length of the cooling element can be cut shorter.

LIST OF DRAWINGS

Figure 2:
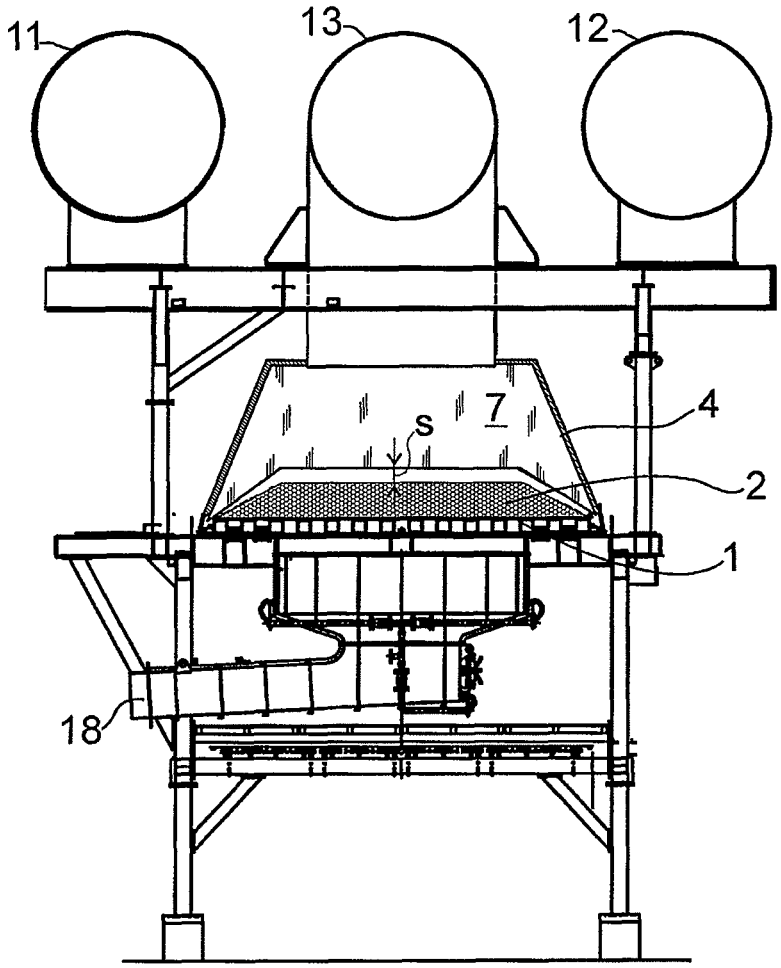

The invention is explained in more detail below with reference to exemplifying embodiments and to the appended drawings, where FIG. 1 is a schematical illustration of one embodiment of the strand sintering equipment according to the invention, and FIG. 2 is a cross-sectional illustration of the strand sintering equipment illustrated in FIG. 1.

DETAILED DESCRIPTION OF INVENTION

FIG. 1 illustrates a strand sintering equipment for continuous sintering of pelletized mineral material. The equipment comprises a strand sintering furnace 3, which is divided into a number of sequential process zones, each of said zones having different temperature conditions. The zones include a drying zone I, a heating zone II and a sintering zone III, where pellets are sintered, and thereafter three successive cooling zones V, VI, VI, where the sintered pellets are cooled. The cooling zones are formed of cooling chambers 4, 5, 6. The cooling chambers 4 and 5 are mutually separated by a partition wall 7, and the cooling chambers 5 and 6 are separated by a partition wall 8. The conveyor belt 1 is a perforated steel band, where the perforation allows the gas to flow through. Wet fresh pellets are fed at the forward end of the furnace (in the drawing the left-hand side) on top of the steel band 1 by a roll feeder in order to form a bed that is several tens of centimeters thick. The conveyor belt 1 proceeds as an endless loop around a deflector roll 9 and a driven roll 10. Above the conveyor belt 1, there are three overhead circulation gas ducts 11, 12, 13, which conduct gas from the cooling zones V, VI, VII to the drying, heating and sintering zones I, II, III, on top of the pellet bed. The circulation gas ducts 12 and 13 both have a burner 23 for heating gas. The lower exhaust gas ducts 14, 15, 16, 17, which are located below the conveyor belt 1, boosted by the blowers 24, 25, 26, 27, conduct the gas that was conducted through the pellet bed and the conveyor belt away from the drying, heating and sintering zones I, II, III. Lower inlet gas ducts 18, 19, 20, 21 conduct gas from below the conveyor belt 1 to the cooling zones V, VI and VII. A blower 22 is arranged to set the gas in motion in the inlet gas ducts 18, 19, 20, 21.

As is seen in FIG. 2, the partition wall 7 is in the height direction located at a distance from the pellet bed 2, so that in between the partition wall 7 and the pellet bed 2, there is left a gap s, through which the gas can circulate between the adjacent cooling chambers 4 and 5.

The invention is not restricted to the above described embodiment only, but many modifications are possible within the scope of the inventive idea defined in the appended claims.

The invention claimed is:

1. A method for continuous sintering of pelletized mineral material, in which method pellets are provided on a sintering underlay (1) to form an essentially even pellet bed (2) with a predetermined thickness;

the pellet bed (2) is conveyed on the sintering underlay (1) through process zones (I-VII) having different temperatures, including at least one drying/heating/sintering zone (I, II, III) and thereafter at least two cooling zones (V, VI, VII), and during the conveying process, gas is conducted through the pellet bed (2) as the pellet bed proceeds through the process zones, characterized in that gas is allowed to circulate on top of the pellet bed (2) between two adjacent cooling zones (V, VI; VI, VII) in order to equalize the pressure therebetween.

2. A strand sintering equipment for continuous sintering of pelletized mineral material, said equipment comprising a strand sintering furnace (3), which is divided into a number of sequential process zones having different temperature conditions, said zones including at least one drying/heating/sintering zone (I, II, III), where pellets are sintered, and thereafter at least two successive cooling zones (V, VI, VI), where the sintered pellets are cooled, and where the cooling zones are formed of cooling chambers (4, 5, 6), each of said two adjacent cooling chambers being separated by a partition wall (7, 8), a conveyor belt (1), which is arranged as an endless loop around a deflector roll (9) and a driven roll (10) for conveying the pellet bed, having a predetermined thickness, through the process zones of the strand sintering furnace, said conveyor belt being made permeable to gas, an overhead circulation gas duct (11, 12, 13), which is placed above the conveyor belt (1) for conducting gas from the cooling zones (V, VI, VII) to the drying/heating/sintering zones (I, II, III) on top of the pellet bed, a lower exhaust gas duct (14, 15, 16, 17), which is located below the conveyor belt (1), for conducting the gas that was conducted through the pellet bed and the conveyor belt, and is exhausted from the drying/heating/sintering zone (I, II, III), a lower inlet gas duct (18, 19, 20, 21) which is located below the conveyor belt (1) for conducting gas to a cooling zone (V, VI, VII), and a blower (22), which is arranged to set the gas in motion in the inlet gas duct (18, 19, 20, 21), characterized in that the partition wall (7, 8) is in the height direction placed at a distance from the pellet bed, so that in between the partition wall and the pellet bed, there is left a gap (s) for allowing a gas flow between two adjacent cooling chambers (4, 5; 5; 6) through the gap (s) in order to equalize the pressure between the cooling chambers.

* * * * *